US009064653B2

(12) United States Patent
Prest et al.

(10) Patent No.: US 9,064,653 B2
(45) **Date of Patent: *Jun. 23, 2015**

(54) ACCESSORY CONTROLLER FOR ELECTRONIC DEVICES

(71) Applicant: Apple Inc., Cupertino, CA (US)

(72) Inventors: Christopher D. Prest, Cupertino, CA (US); Claudio V. Di Leo, Cambridge, MA (US); Jahan C. Minoo, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/507,666

(22) Filed: Oct. 6, 2014

(65) Prior Publication Data

US 2015/0021148 A1 Jan. 22, 2015

Related U.S. Application Data

(63) Continuation of application No. 14/188,633, filed on Feb. 24, 2014, now Pat. No. 8,853,581, which is a continuation of application No. 13/681,162, filed on Nov. 19, 2012, now Pat. No. 8,658,926, which is a (Continued)

(51) Int. Cl.
*H01H 5/18* (2006.01)
*H01H 13/7057* (2006.01)

(Continued)

(52) U.S. Cl.
CPC ..... *H01H 13/7057* (2013.01); *H01H 2203/038* (2013.01); *H01H 2239/01* (2013.01);

(Continued)

(58) Field of Classification Search
CPC ..... H01H 13/7057; H01H 2203/038; H01H 2239/01; H01H 2239/048; H01H 2203/056; H01H 13/76; H01H 13/10; H01H 13/81; H01H 13/86; H01R 1/1041
USPC ..... 200/1 B, 1 R, 5 A, 5 B, 18, 275, 406, 200/512–517; 439/632, 676, 669
See application file for complete search history.

(56) References Cited

U.S. PATENT DOCUMENTS 3,052,785 A 9/1962 Herrmann et al.
3,436,495 A 4/1969 Gorike (Continued)

FOREIGN PATENT DOCUMENTS

CN 2372858 4/2000
CN 1671250 9/2005

(Continued)

OTHER PUBLICATIONS

Author Unknown, "TRS Connector," Wikipedia, http://en.wikipedia.org/wiki/TRS_connector, at least as early as Jul. 28, 2008.

*Primary Examiner* — Edwin A. Leon
(74) *Attorney, Agent, or Firm* — Brownstein Hyatt Farber Schreck LLP

(57) ABSTRACT

Accessories such as headsets for electronic devices are provided. A headset may be provided with a button controller assembly that has user-actuated buttons and a microphone. The microphone may be formed by mounting a microphone transducer on a printed circuit board. A housing may be mounted over the transducer to form a sealed cavity for the transducer. Circuitry may be mounted on portions of the printed circuit board that extend beyond the edges of the microphone housing. The button controller assembly may have dome switches. The dome switches may have a housing that encloses dome switch components and that forms a structural internal part for the button controller. The dome switch housing structure may have tabs or other engagement features that mate with corresponding engagement features in a button member. The button member may be pressed by a user to actuate a desired dome switch.

25 Claims, 22 Drawing Sheets

Related U.S. Application Data continuation of application No. 12/703,172, filed on Feb. 9, 2010, now Pat. No. 8,314,354.

(60) Provisional application No. 61/232,374, filed on Aug. 7, 2009, provisional application No. 61/230,073, filed on Jul. 30, 2009, provisional application No. 61/228,939, filed on Jul. 27, 2009.

(51) Int. Cl.

| | |
|---|---|
| ***H04R 1/10*** | (2006.01) |
| ***H01H 13/76*** | (2006.01) |
| ***H01H 13/10*** | (2006.01) |
| ***H01H 13/81*** | (2006.01) |
| ***H01H 13/86*** | (2006.01) |

(52) U.S. Cl.

CPC ..... *H01H2239/048* (2013.01); *H04R 1/1041* (2013.01); *H01H 13/76* (2013.01); *H01H 13/10* (2013.01); *H01H 13/81* (2013.01); *H01H 13/86* (2013.01); *H01H 2203/056* (2013.01)

(56) References Cited

U.S. PATENT DOCUMENTS

| | | | | |
|---|---|---|---|---|
| 4,479,112 | A | 10/1984 | Hirsch | |
| 4,731,833 | A | 3/1988 | Gumb et al. | |
| RE35,536 | E | 6/1997 | Irissou et al. | |
| 5,649,307 | A | 7/1997 | Patino | |
| 5,701,355 | A | 12/1997 | Brannan et al. | |
| 5,898,147 | A | 4/1999 | Domzalski et al. | |
| 6,122,369 | A | 9/2000 | Hwang et al. | |
| 6,271,487 | B1 | 8/2001 | Domzalski et al. | |
| 6,677,843 | B1 | 1/2004 | Monroe et al. | |
| 6,745,014 | B1 | 6/2004 | Seibert et al. | |
| 6,771,780 | B2 | 8/2004 | Hong | |
| 6,856,046 | B1 | 2/2005 | Scarlett et al. | |
| 6,961,591 | B2 | 11/2005 | Osano | |
| 6,988,905 | B2 | 1/2006 | Corey et al. | |
| 7,110,799 | B1 | 9/2006 | Willins et al. | |
| 7,166,910 | B2 | 1/2007 | Minervini | |
| 7,235,754 | B2 | 6/2007 | Rochon et al. | |
| 7,349,546 | B2 | 3/2008 | Ganton | |
| 7,450,726 | B2 | 11/2008 | Goyal | |
| 7,532,732 | B2 | 5/2009 | Denninghoff | |
| 7,652,888 | B2 | 1/2010 | Bohlinger et al. | |
| 7,783,057 | B2 | 8/2010 | Park | |
| 7,836,216 | B2 | 11/2010 | Kashi | |
| 7,869,608 | B2 | 1/2011 | Sander et al. | |
| 7,912,501 | B2 | 3/2011 | Johnson et al. | |
| 8,144,915 | B2 | 3/2012 | Hankey et al. | |
| 8,222,553 | B2 * | 7/2012 | Zieder | 200/406 |
| 8,260,380 | B2 | 9/2012 | Kim | |
| 8,278,580 | B2 * | 10/2012 | Zieder | 200/406 |
| 8,314,354 | B2 * | 11/2012 | Prest et al. | 200/406 |
| 8,658,926 | B2 * | 2/2014 | Minoo et al. | 200/406 |
| 8,853,581 | B2 * | 10/2014 | Prest et al. | 200/406 |
| 2001/0053228 | A1 | 12/2001 | Jones | |
| 2003/0060242 | A1 | 3/2003 | Dotzler | |
| 2005/0201568 | A1 | 9/2005 | Goyal | |
| 2006/0148314 | A1 | 7/2006 | Castaneda et al. | |
| 2007/0004472 | A1 | 1/2007 | Gitzinger | |
| 2007/0225049 | A1 | 9/2007 | Andrada | |
| 2008/0032753 | A1 | 2/2008 | Nho | |
| 2008/0039072 | A1 | 2/2008 | Bloebaum | |
| 2008/0166003 | A1 | 7/2008 | Hankey et al. | |
| 2008/0277257 | A1 | 11/2008 | Huang et al. | |
| 2010/0054493 | A1 | 3/2010 | Lin et al. | |

FOREIGN PATENT DOCUMENTS

| | | |
|---|---|---|
| CN | 200966132 | 10/2007 |
| CN | 201018635 | 2/2008 |
| CN | 201226586 | 4/2009 |
| CN | 102379018 | 3/2012 |
| EP | 1542250 | 6/2005 |
| EP | 1986205 | 10/2008 |
| TW | M324815 | 1/2008 |
| WO | WO 99/57937 | 11/1999 |
| WO | WO 02/45463 | 6/2002 |
| WO | WO 03/056790 | 7/2003 |
| WO | WO 2008/085915 | 7/2008 |
| WO | WO 2008/085929 | 7/2008 |

* cited by examiner

ACCESSORY CONTROLLER FOR ELECTRONIC DEVICES

This application is a continuation patent application of U.S. patent application Ser. No. 14/188,633, filed Feb. 24, 2014 and titled "Accessory Controller for Electronic Devices," which is a continuation patent application of U.S. patent application Ser. No. 13/681,162, filed Nov. 19, 2012, now U.S. Pat. No. 8,658,926 and titled "Accessory Controller for Electronic Devices," which is a continuation patent application of U.S. patent application Ser. No. 12/703,172, filed Feb. 9, 2010 and titled "Accessory Controller for Electronic Devices," now U.S. Pat. No. 8,314,354, which claims the benefit of U.S. Provisional Patent Application No. 61/228,939, filed Jul. 27, 2009 and titled "Accessory Controller for Electronic Devices," and U.S. Provisional Patent Application No. 61/230,073, filed Jul. 30, 2009 and titled "Accessory Controller for Electronic Devices," and U.S. Provisional Patent Application No. 61/232,374, filed Aug. 7, 2009 and titled "Accessory Controller for Electronic Devices," the disclosures of which are hereby incorporated by reference herein in their entireties.

BACKGROUND

This relates to electronic devices, and more particularly, to accessories for electronic devices with input components such as buttons and microphones.

Electronic devices such as computers, media players, and cellular telephones typically contain user interface components that allow these devices to be controlled by a user. It is sometimes desirable to add accessories to electronic devices. For example, a user may desire to plug a headset or adapter accessory into an electronic device to allow the user to listen to audio.

Headsets are sometimes provided with buttons and microphones. A headset microphone may be used to pick up a user's voice during a telephone call. Buttons may be used to control media file playback, to make volume level adjustments during a telephone call, and to issue other commands for the electronic device. Buttons and a microphone may be mounted within a button controller assembly. Microphone signals and button signals may be routed from the button controller assembly to an electronic device using wires in the headset.

The designers of accessories and other electronic equipment often attempt to reduce component size and part counts while retaining desired levels of functionality. Reduced component sizes and reduced part counts help to reduce device complexity and expense.

It would therefore be desirable to provide improved electronic device accessories such as accessories with improved buttons, microphones, and button controller assemblies.

SUMMARY

Electronic device accessories such as headsets with button controller assemblies are provided. A button controller assembly may include buttons and a microphone.

A microphone for the button controller assembly or other device may be formed by mounting an audio transducer to a substrate. The substrate may be a printed circuit board or other substrate that includes extending portions onto which integrated circuits and other components can be mounted. If desired, microphone components and other components can be mounted to substrates formed from parts of a housing.

Button functionality for the button controller assembly and other devices may be provided using switches that are actuated by button members. When a user presses a button member, the button member bears against the switch.

Multiple buttons may be formed using a single flexible button structure. The switches may be implemented using dome switches.

The dome switches may have housings that directly mate with the button members. For example, the dome switch housings may have tabs that protrude into corresponding openings on a button structure. The housings of multiple dome switches may be formed from an integral structure. A printed circuit board may be mounted to the underside of the integral housing structure. Components such as integrated circuits, dome switch terminals, discrete circuit elements, microphone components, and other circuitry may be connected to the printed circuit board. Cavities in the dome switch housing member may receive the components that are mounted to the printed circuit board.

Further features of the invention, its nature and various advantages will be more apparent from the accompanying drawings and the following detailed description of the preferred embodiments.

DETAILED DESCRIPTION

This relates to structures such as microphone and button structures that may be used in a button controller assembly for an electronic device accessory.

Electronic components such as microphones and buttons may be used in a wide range of applications. For example, microphones and buttons may be used to form a button controller for a headset or other accessory. Button controller assemblies that are suitable for use in headsets are sometimes described herein as an example. In general, however, button structures and microphone structures may be used in any suitable system.

Figure 1:
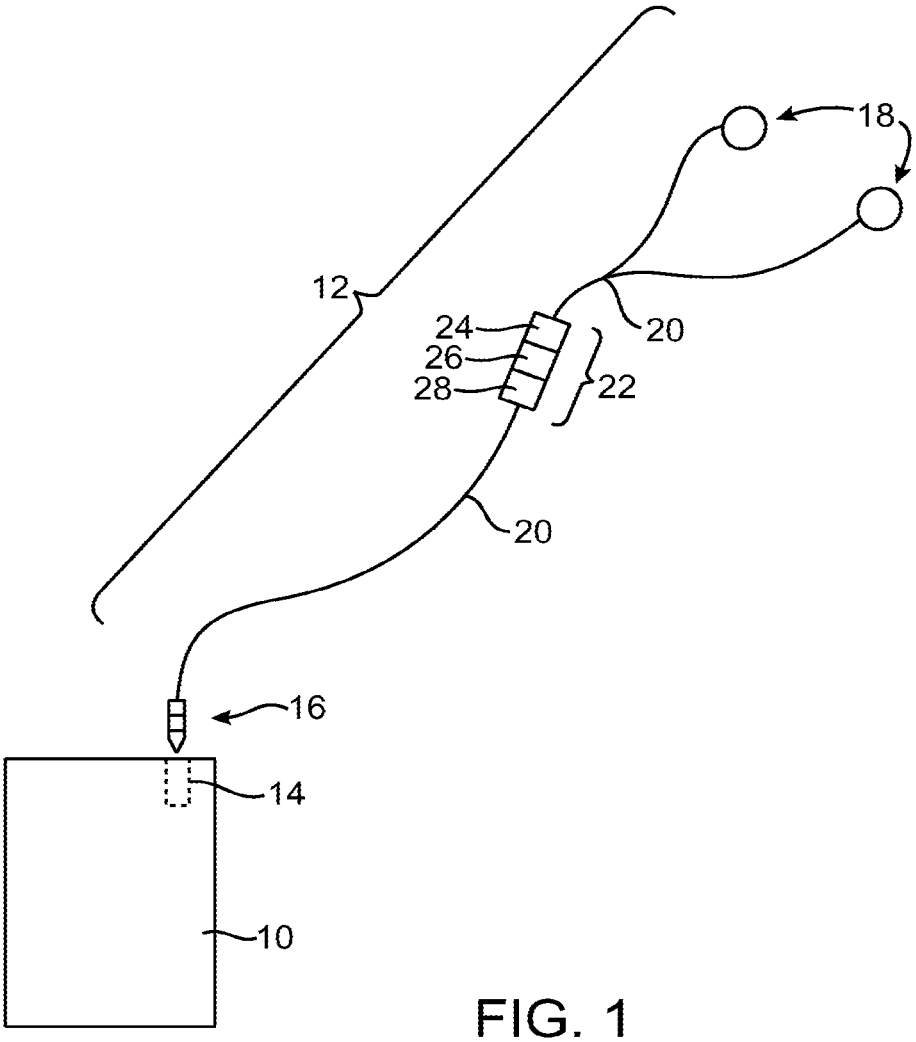
FIGS. 1-22 show various structures in accordance with embodiments of the present invention.

An illustrative system in which an accessory may be used with an electronic device is shown in FIG. 1. As shown in FIG. 1, electronic device 10 may be coupled to an accessory such as headset 12 by plugging plug 16 of accessory 12 into jack 14 of electronic device 10.

Electronic device 10 may be a desktop or portable computer, a handheld electronic device such as a cellular telephone or media player, a tablet device, or any other suitable electronic device. Headset 12 may have speakers 18 and button controller assembly 22. Button controller assembly 22 and speakers 18 may be coupled to device 10 using cable 20 (e.g., a three-wire or four-wire headset cable). Button controller assembly 22 may, if desired, include a microphone. The microphone may be used by a user of device 10 and headset 12 during a telephone call (e.g., to pick up the user's voice).

Button controller assembly 22 may include buttons such as buttons 24, 26, and 28. There may, in general, be any suitable number of buttons in button controller assembly (e.g., one or more buttons, two or more buttons, three or more buttons, etc.). With one suitable arrangement, which is sometimes described herein as an example, button controller assembly 22 may include three buttons. These buttons may be used to issue commands for device 10. Examples of commands that may be issued for device 10 using the buttons of button controller assembly 22 include stop, forward, and reverse commands, volume up and down commands, telephone call control commands, etc.

Figure 2:
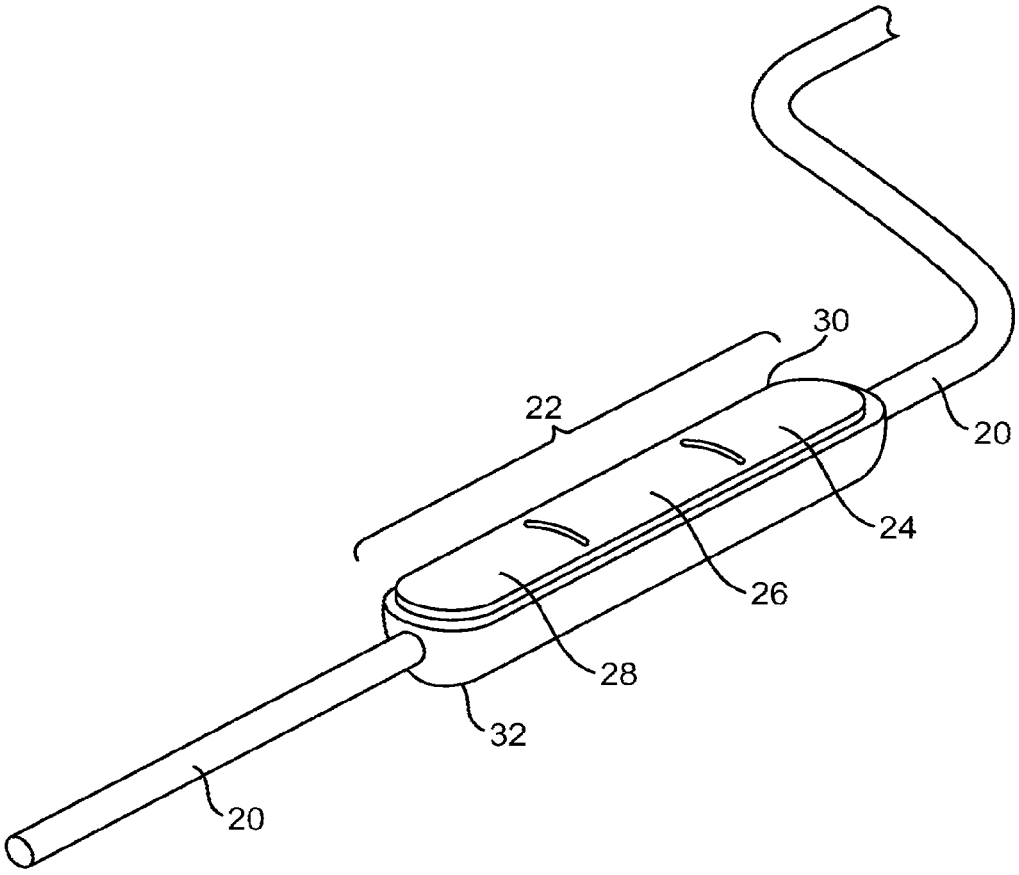

A perspective view of an illustrative button controller is shown in FIG. 2. As shown in FIG. 2, button controller 22 may have an upper member 30 and a lower member 32. Upper member 30 may be used to form buttons 24, 26, and 28 and may therefore sometimes be referred to as a button structure or button member. Lower member 32 may be used to help enclose mechanical and electrical components in button controller 22 and may therefore sometimes be referred to as a button controller housing or enclosure. In the example of FIG. 2, button member 30 is used to form multiple buttons (i.e., buttons 24, 26, and 28). This type of integral button member arrangement is, however, merely illustrative. Button members such as button member 30 may be used in forming a single button or multiple buttons. In configurations in which a single button member is used in forming multiple buttons, each portion of the button member may be flexed independently of the other portions of the button member. This allows a user to press one button (e.g., button 28) without activating the other buttons (e.g., buttons 26 and 24).

Figure 3:
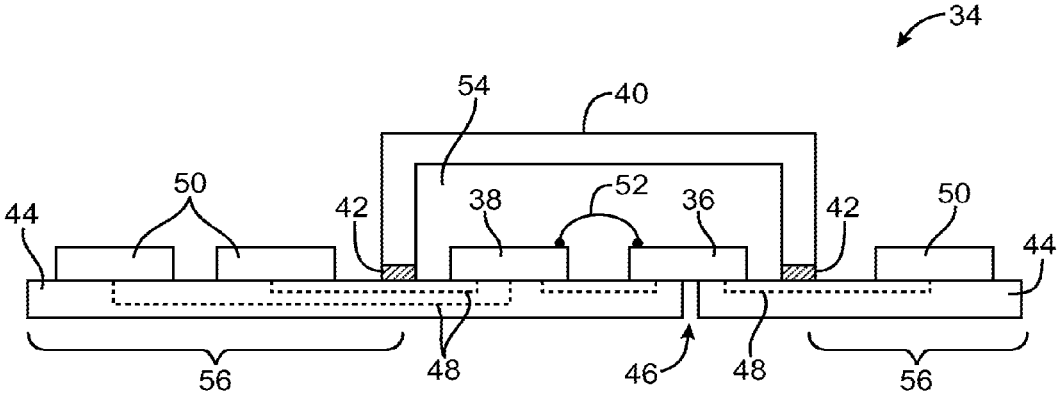

A cross-sectional side view of an illustrative microphone assembly of the type that may be used in button controller 22 or other equipment is shown in FIG. 3. As shown in FIG. 3, microphone assembly 34 (which may sometimes be referred to as a microphone or microphone structure) may have an audio transducer such as transducer 36. Transducer 36 may be used to convert sound into electrical signals. Transducer 36 may be formed using microelectromechanical systems (MEMS) technology. For example, transducer 36 may have a thin MEMS diaphragm. Transducer 36 may be mounted to substrate 44 (e.g., using epoxy, solder, etc.). A vertical opening such as hole 46 may be formed through substrate 44 to allow sound to enter transducer 36. Housing 40 may be mounted over transducer 36 to form sealed cavity 54 (e.g., using epoxy 42 or other suitable adhesives).

Microphone assembly 34 may include circuitry such as circuitry 38. Circuitry 38 may include discrete electrical components, application-specific integrated circuits (ASICs) and other suitable circuits. Circuitry 38 may be mounted on substrate 44 (e.g. in cavity 54 within housing 40).

Substrate 44 may contain conductive lines (traces) such as traces 48. Traces 48 may be used to interconnect microphone transducer 36 and circuitry 38. Wire bonds such as wire bond 52 may also be used in interconnecting transducer 36 to circuitry 38 if desired.

Substrate 44 may have extending portions such as portions 56 that extend beyond the edges of housing 40. Circuitry 50 may be mounted on the upper and lower surfaces of substrate 44 (e.g., in regions 56). Conductive traces 48 may be used to interconnect circuitry 50, circuitry 38, and transducer 36. Circuitry 50 and 38 may include switches, capacitors, resistors, inductors, integrated circuits, etc.

Housing 40 may be formed from any suitable material (e.g., metal, plastic or other dielectric materials, etc.). Substrate 44 is preferably formed from a material that accommodates conductive lines 48. As an example, substrate 44 may be formed from a dielectric such as plastic or other polymers. If desired, substrate 44 may be formed as part of a housing. Conductive traces may be formed on a plastic housing or other substrate by forming a patterned seed layer followed by electroplating (as an example). Conductive traces may also be formed by screen printing, physical vapor deposition and photolithography, insert molding (e.g., to embed metal wires, patterned metal foil, or other conductive structures within an encapsulating plastic structure), etc. With one suitable arrangement, substrate 44 is a printed circuit board. Printed circuit board materials that may be used for substrate 44 include rigid printed circuit board materials such as fiberglass filled epoxy (e.g., FR4) and flexible printed circuit board materials (e.g., flexible polymers such as polyimide). Flexible printed circuit boards are sometimes referred to as flex circuits.

Figure 4:
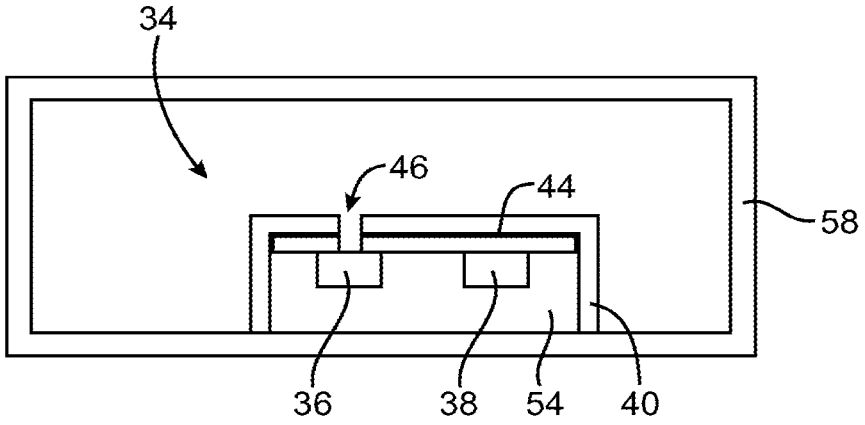

FIG. 4 shows a cross-sectional side view of an illustrative configuration for microphone 34 in which port 46 is formed from an opening that passes through both substrate 44 and housing 40. Housing 40 may be mounted to structure 58 (e.g., a structural component of button assembly 22 such as a portion of a housing). Transducer 36 may be mounted adjacent to acoustic port 46. Circuitry 38 may be mounted within the sealed cavity formed by housing 40 (cavity 54). Substrate 44 in the configuration of FIG. 4 may be formed from rigid or flexible printed circuit board, plastic (e.g., part of a housing structure such as housing 40), etc.

Figure 5:
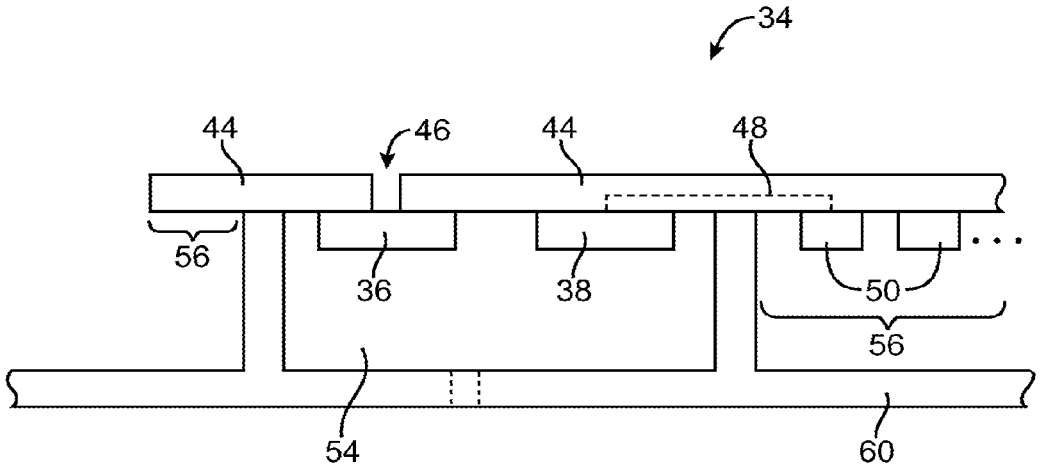

Another configuration that may be used for microphone 34 in button assembly 22 is shown in FIG. 5. FIG. 5 is a cross-sectional side view showing how microphone 34 may be formed by mounting transducer 36 and circuitry 38 to the underside of substrate 44. Substrate 44 may be, for example, a flex circuit or rigid printed circuit board. Opening 46 may be formed through substrate 44 to allow transducer 36 to receive sound. Sealed cavity 54 may be formed by attaching substrate 44 to structure 60.

Structure 60 may be, for example, part of a plastic housing or other dielectric structure. Optional substrate extending regions 56 may be provided to allow circuitry 50 to be mounted to microphone assembly 34. Conductive interconnects such as interconnect line 48 may be used to route signals between circuitry 50 and microphone components such as microphone circuitry 38 and transducer 36. Circuitry 50 of FIGS. 3 and 5 may be circuitry for handing microphone signals or other circuitry (e.g., button controller circuitry, general purpose audio circuitry, communications circuitry, etc.).

Figure 6:
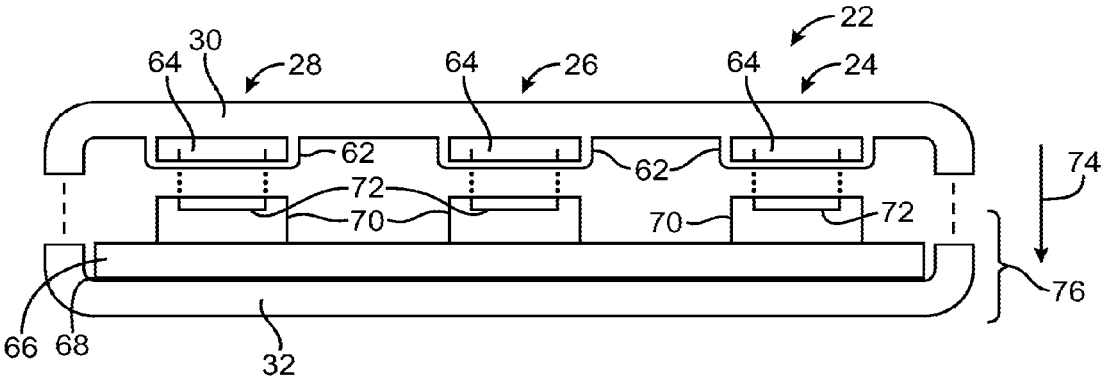

An exploded cross-sectional side view of an illustrative button controller 22 is shown in FIG. 6. As shown in FIG. 6, button controller 22 may have upper and lower portions such as button member 30 and housing member 32. Housing member 32 and button member 30 may be formed from any suitable material (e.g., plastic, metal, etc.). In a typical configuration, button member 30 is formed form a flexible plastic that allows each button (i.e., buttons 28, 26, and 24) to independently flex downward in direction 74. Switches 70 are aligned with the buttons of button member 30, so that when a given button is pressed by a user, the button will flex into contact with a corresponding switch. This actuates the switch. Control circuitry can detect that the state of the switch has changed (e.g., by detecting a closed circuit) and can take appropriate action.

Switches 70 may be formed using any suitable switch structures. With one illustrative configuration, which is sometimes described herein as an example, switches 70 are formed using dome switch structures. Each dome switch 70 includes a hemispherical dome member that can be pressed downward by flexing an appropriate portion of button member 30 in direction 74. When the dome is fully compressed, the inside of the dome member will create a short circuit across the dome switches terminals. The dome may be formed from metal, metalized polymers, etc.

The hemispherical dome member of each dome switch 70 may be mounted to a housing. The housings may have tabs such as tabs 72 or other structures that allow switches 70 to directly mate with button member 30. By mating switches 70 directly to button member 30, button actuation tolerances may be improved relative to arrangements in which switches 70 and button member 30 are more indirectly coupled to each other (e.g., by using a frame or other structures in lower portion 76 of button assembly 22 to couple the dome switches to button member 30).

In the example of FIG. 6, switches 70 have tabs 72 that protrude into and out of the page. Each tab 72 may mate with a corresponding engagement structure in button member 30. For example, each tab 72 may protrude into a corresponding opening 64 in one of portions 62 of button member 30 when button member 30 and lower assembly portion 76 are in an assembled (mated) state. Openings 64 may be larger than tabs 72 to allow button member 30 to travel with respect to switches 70 and the rest of lower portion 76 of button controller assembly 22.

The use of tabs such as tabs 72 and interlocking features such as openings 64 is merely illustrative. Any suitable arrangement may be used to directly mate button member 30 to switches 70 and thereby couple button member 30 to lower portion 76. For example, springs and mating openings may be used, adhesive or other rigid fastening mechanisms may be used, rails and recessed grooves may be used, other interlocking features that capture each other (e.g., using protrusions and recesses, etc.) may be used, etc. The use of dome switch housing protrusions 72 and corresponding button member openings 64 as the engagement structures that hold member 30 and portion 76 of assembly 22 together is merely illustrative. Moreover, it is not necessary for the opening portion of the engagement structures to be formed on member 30. As an example, holes may be formed in the housings of switches 70 into which tabs on button member 30 protrude.

The housings of switches 70 may be connected to structure 66. Structure 66 may be a rigid or flexible printed circuit board, a structural member such as a frame or housing piece, or any other structure. If desired, the housings of switches 70 may be formed from a single piece of material. With this type of arrangement, structure 66 need not be used to form a structural support for the dome switches and can be omitted or formed from a non-structural material (e.g., a flex circuit).

When dome switches such as switches 70 are interconnected to each other using a unitary housing structure or other integral mounting arrangement, it is not necessary to provide an additional printed circuit board on which individual dome switches are mounted. One or more printed circuit boards or other additional structures may, however, be attached to the integral dome switch structure if desired (e.g., to help route signals between dome switches 70 and other circuit components in button controller 22). Arrangements in which the housings for multiple switches 70 are formed a unitary structure such as a single molded plastic part are sometimes referred to as integral frame and switch structure arrangements.

Dome switches 70 and/or structure 66 (whether structure 66 is formed as an integral portion of one or more dome switch housings or as a separate structure) may be connected to housing 32 using adhesive 68 or other suitable fastening mechanisms (e.g., rivets, screws, snaps, etc.). If desired, switches 70, structure 66, and housing 32 may be formed as an integral part (e.g., using one molded plastic part).

Figure 7:
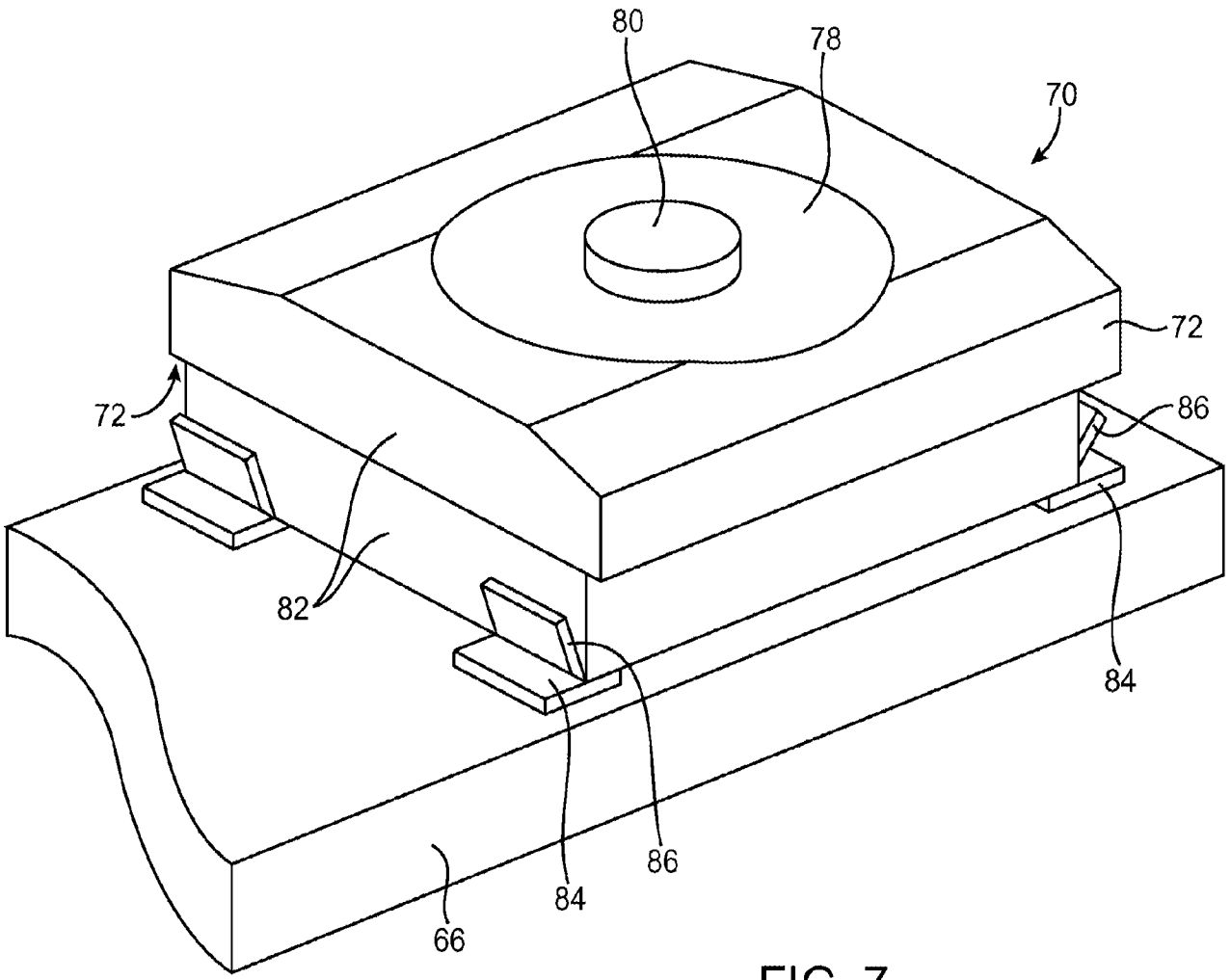

A perspective view of an illustrative dome switch is shown in FIG. 7. As shown in FIG. 7, dome switch 70 may have a housing such as dome switch housing 82. Housing 82 may be formed from a material such as liquid crystal polymer, glass-filled nylon, or other material (e.g., a material that flows well when molding small parts and that is rigid and strong). Switch 70 may have terminals 86 that are soldered to respective contact pads 84 on structure 66. Structure 66 may be, for example, a substrate such as a flex circuit or a rigid printed circuit board.

As illustrated in FIG. 7, protrusions (tabs) 72 may be formed as an integral portion of housing 82. Hemispherical dome switch diaphragm 78 may be mounted in housing 82. Nub 80 may be formed from epoxy or other suitable material and serves as a durable point of contact between dome switch 70 and the lower surface of button member 30 during operation of switch 70.

Although only a single switch 70 is shown in the example of FIG. 7, additional switches 70 may be rigidly connected together. For example, individual switches 70 may be mounted on the same substrate 66. If desired, the length of housing 82 may be extended so that multiple switches 70 can be formed using a single unitary structure. This unitary switch housing structure may be sufficiently strong that substrate 66 can be omitted or so that substrate 66 may be made of a flexible material (i.e., a flex circuit substrate).

Figure 8:
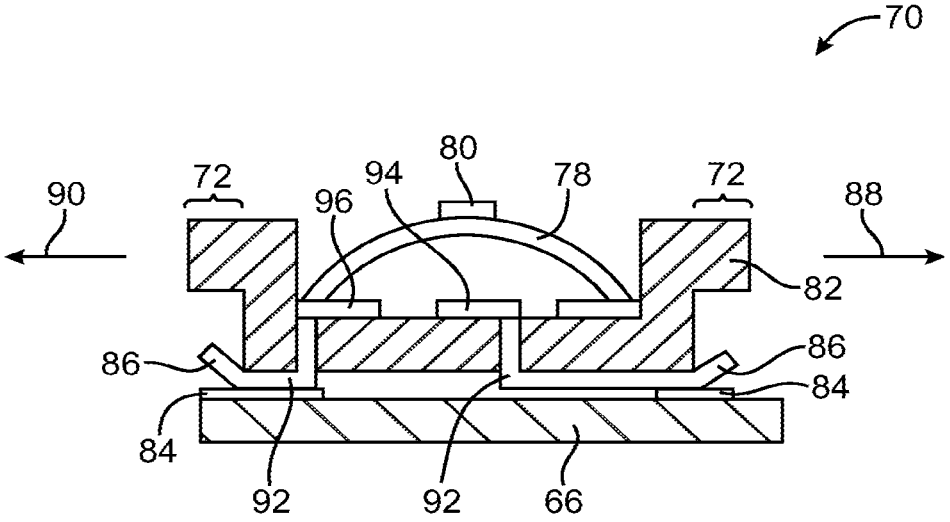

A cross-sectional end view of an illustrative dome switch is shown in FIG. 8. As shown in FIG. 8, dome switch 70 may have a dome member such as hemispherical conductive dome member 78 that is mounted in housing 82. Protrusions 72 may extend laterally in directions 88 and 90 to mate with corresponding holes 64 in button member 30 (FIG. 6). Terminals 86 may be formed using metal foil members 92 or other conductive structures. These structures may be electrically connected to dome 78 and inner switch contact pad 94. When dome 78 is compressed, peripheral pad 96 and central pad 94 are shorted to each other, thereby closing switch 70.

Figure 9:
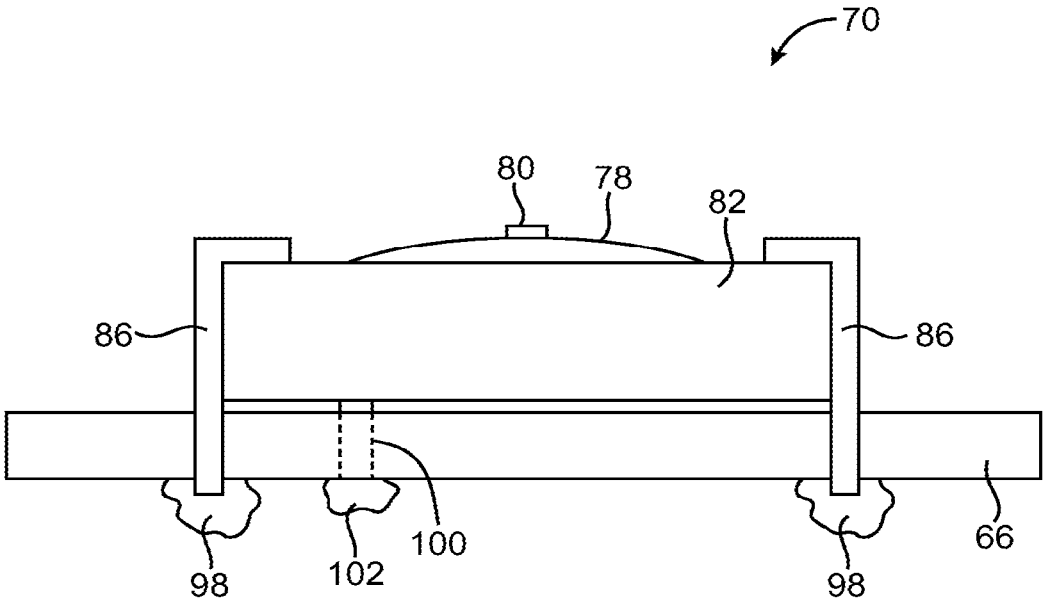

The cross-sectional side view of FIG. 9 shows how terminals 86 may be formed from metal structures that pass through holes in substrate 66. This type of configuration may help retain switch 70 and its housing 82 on substrate 66. Solder 98 may be used to help attach structures 86 to traces on substrate 66 and may help retain structures 86 in the holes of substrate 66. As shown by dashed line 100 and solder 102, metal terminal structures and other such structures that hold switch 70 to substrate 66 may be formed under switch 70 (e.g., to avoid the lateral size constraints imposed by using metal terminal structures that run along the exterior edges of housing 82).

Figure 10:
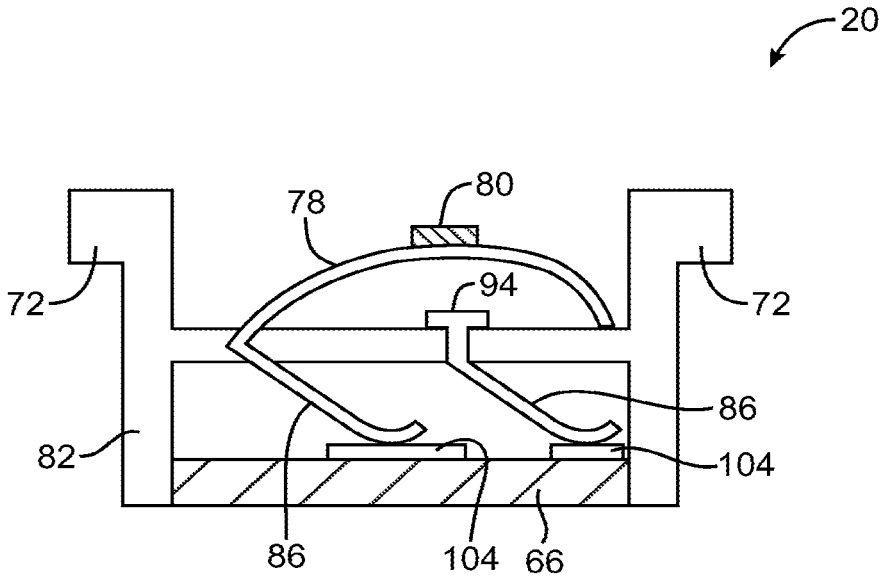

As shown in FIG. 10, terminal structures 86 may be formed using bent metal springs. With the spring arrangement of FIG. 10, the bent metal of each terminal 86 contacts a respective contact pad (i.e., contact pads 104) on the surface of substrate 66. This type of configuration avoids the need to use solder, which may facilitate assembly and rework operations.

Figure 11:
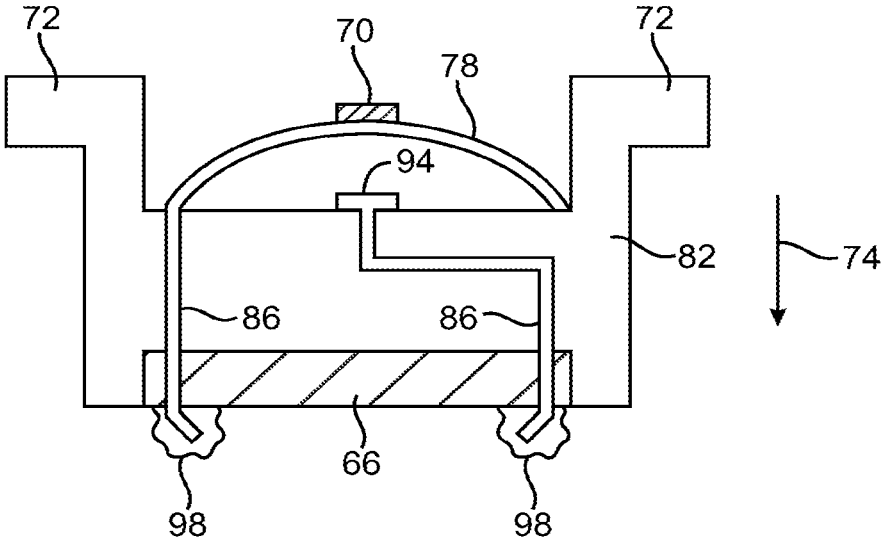

FIG. 11 is a cross-sectional side view of an illustrative configuration that may be used for switch 70 in which substrate 66 is mounted within a recess in the underside of switch housing 82. Switch housing 82 may be, for example, a unitary housing structure that receives multiple hemispherical dome members 78 and that serves as a structural support member (e.g., a frame). Substrate 66 may be a printed circuit board (e.g., a flex circuit) and need not provide structural support for switches 70. Solder connections 98 may be used to interconnect traces on circuit board 66 to switch terminals 86. Other circuits (e.g., microphone 34, integrated circuits, and other circuitry) may be mounted on printed circuit board 66 if desired. Such other circuits may be mounted on the upper side of circuit board 66 (e.g., so that these components protrude into recesses within the underside of housing structure 82) or on the lower surface of printed circuit board 66 (e.g., so that these components protrude downward in direction 74.

Figure 12:
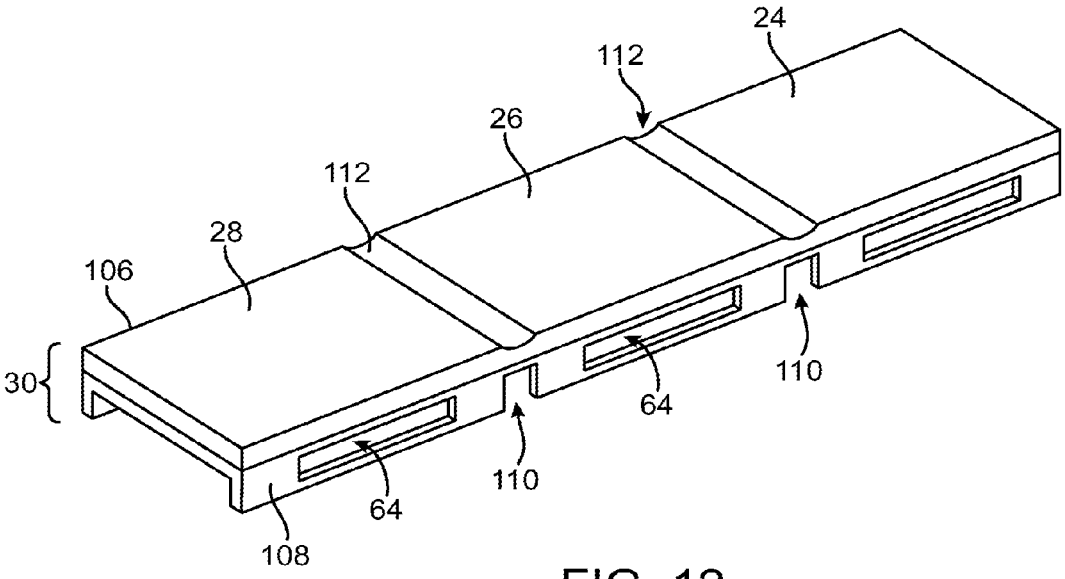

A perspective view of an illustrative button member for button controller 22 is shown in FIG. 12. As shown in FIG. 12, button member 30 may have a frame structure 108 and button structure 106. Button structure 106 and frame member 108 may be formed as a single unitary piece of material (e.g., using metal, plastic, or other suitable materials). In the example shown in FIG. 12, button structure 106 and button frame member 108 are formed from separate materials. Frame 108 may be formed from metal or other materials and may have holes 64 that engage tabs 72 on dome switches 70. Button structure 106 serves as a button cover and may be formed from plastic, metal, or other materials. With one suitable arrangement, frame 108 is formed from metal and button structure 106 is formed from plastic (e.g., a thermoplastic) that is molded onto frame 108.

Button structure 106 may have grooves 112 and frame 108 may have notches 110. These recessed portions of structures 106 and 108 may be interposed between respective buttons (i.e., between button 28 and 26 and between button 26 and 24). Because there is less material in button member 30 in the vicinity of grooves 112 and notches 110, button member 30 exhibits enhanced flexibility in these thinned regions. This enhanced flexibility helps to isolate the buttons from each other, so that only a desired button flexes when pressed by a user.

Figure 13:
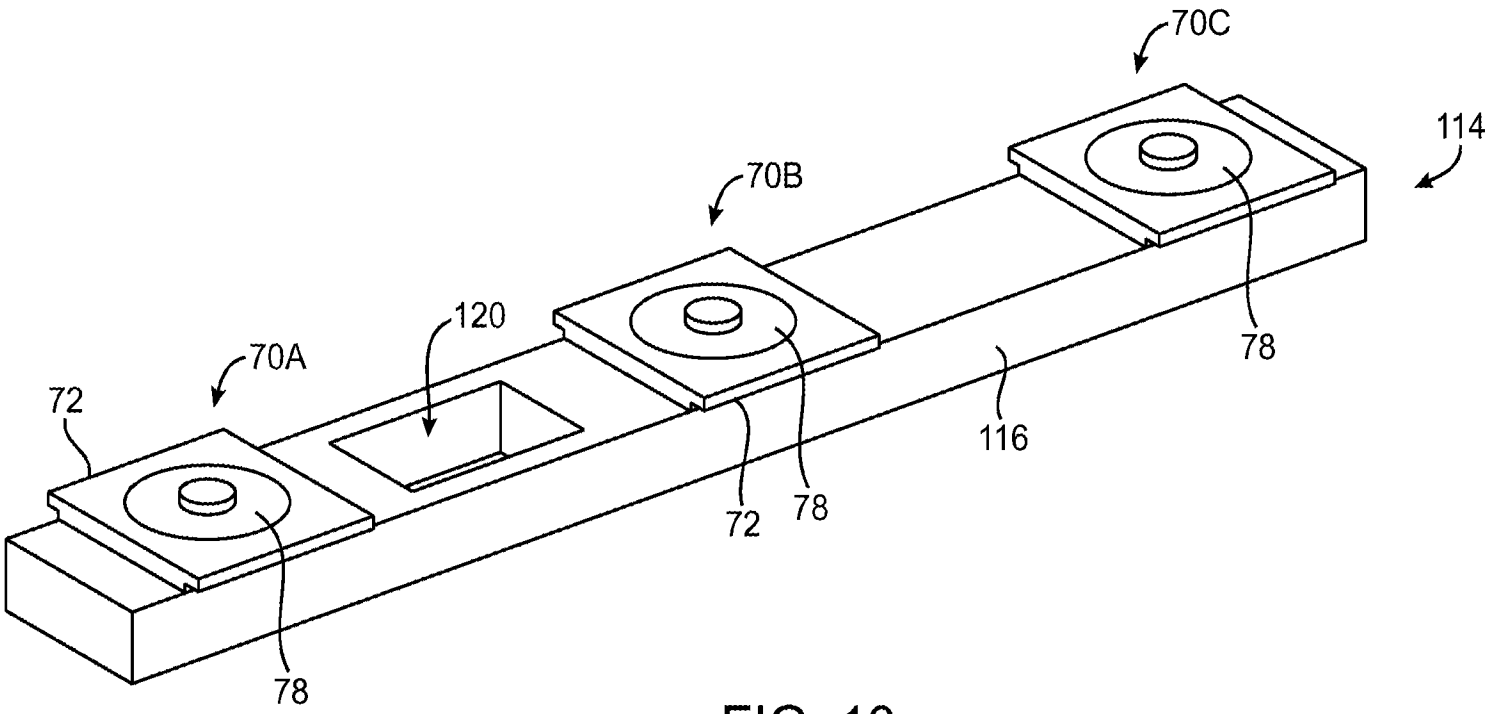

An interior portion of button controller assembly 22 is shown in FIG. 13. In the example of FIG. 13, button controller structures 114 are of the type that are configured to mate with button member 30 of FIG. 12. Structures 114 include three dome switches: switch 70A, switch 70B, and switch 70C. Each dome switch may have associated tabs 72 that extend laterally outward for engagement with holes 64 in frame 108 (FIG. 12). Support structure 116 may be formed from plastic, metal, printed circuit board material, or other suitable materials. With one suitable arrangement, structure 116 and the housings of switches 70A, 70B, and 70C are formed from a single unitary piece of plastic (i.e., structure 116 may be a dome switch housing member). Opening 120 may be used to accommodate housing 40 of microphone 34 (e.g., microphone 34 of FIG. 3) and other circuitry and components for button controller assembly 22.

Button controller structures 114 may sometimes be referred to herein as a low profile switch assembly and a small form factor switch assembly (e.g., relative to audio cable 20 and the average size of a user's finger). Support structure 116 may form an enclosure for the electrical components associated with switches 70A, 70B, and 70C. Instead of having structure 116 only support discrete and self-contained switches, switches 70A, 70B, and 70C may be built into a single body such as structure 116 (sometimes referred to as a unitary switch body (e.g., the switches may be integrated in, embedded in, integral with, molded in, or internally disposed within structure 116). Structure 116 may be referred to herein as a unitary switch body (e.g., a single piece of material such as a single piece of molded plastic having integral switches 70A, 70B, and 70C. This type of arrangement may help to reduce the number of components in a switch assembly (which may facilitate building smaller switch assemblies and which may also facilitate manufacturing of the switch assemblies by reducing the number of components).

Figure 14:
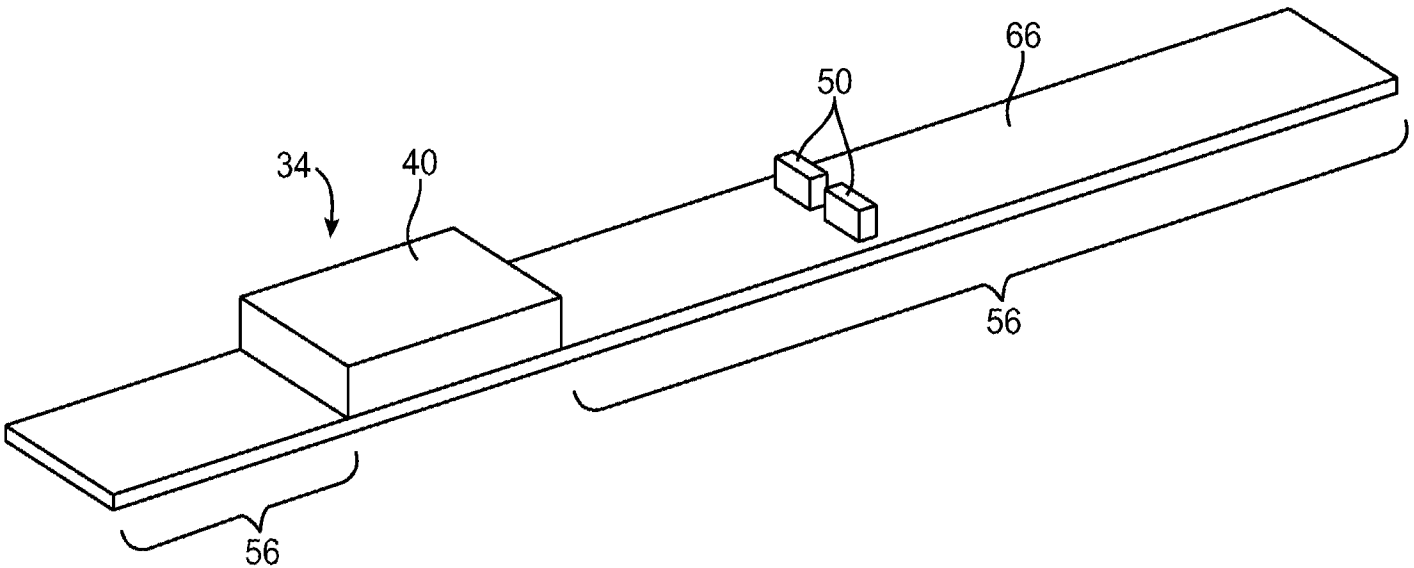

An illustrative printed circuit 66 on which housing 40 of microphone 34 may be mounted for assembly with structures 114 of FIG. 13 is shown in FIG. 14. As shown in FIG. 14, housing 40 of microphone 34 may be mounted in a portion of printed circuit 66 that allows housing 40 to protrude into opening 120 of FIG. 13 when printed circuit board 66 is mounted to the underside of structures 114 of FIG. 13. Printed circuit board 66 may be formed from any suitable structure such as a printed circuit board, a rigid printed circuit board, a rigid-flex printed circuit board, a flexible printed circuit board, a flexible circuit, one or more integrated circuits or chips, and any other suitable structure or medium for circuitry. Printed circuit board 66 and may have extending regions 56 on which circuitry 50 and other components may be mounted (as described in connection with extending portions 56 of substrate 44 in FIG. 3). With one suitable arrangement, printed circuit board 66 may be integrated into structure 116 to form switch assembly 114. As examples, printed circuit board 66 may be integral with, internal to, within, or internally disposed within the confines of unitary structure 116. In general, printed circuit board 66 may include any desired circuits and circuit components. For example, circuit board 6 may include electrical components associated with switches 70A, 70B, and 70C and/or other electrical components such as components associated with microphone 34 and other circuitry.

Figure 15:
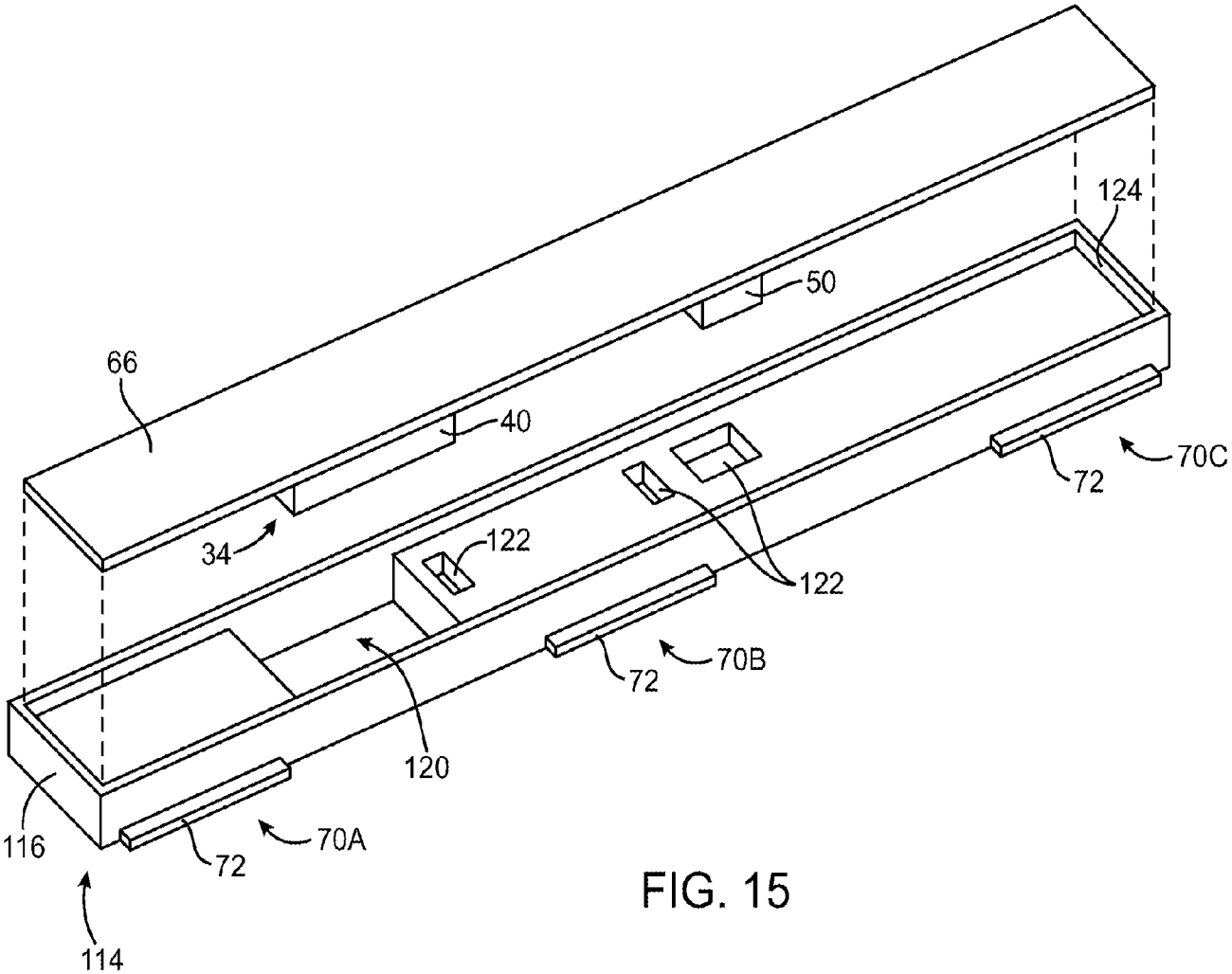

FIG. 15 is an exploded perspective view of printed circuit board 66 and microphone housing 40 of FIG. 14 in alignment with opening 120 and the underside of structure 114 of FIG. 13. As shown in FIG. 15, structure 116 may have a printed circuit board recess formed from shallow sidewalls 124. Printed circuit board 66 may have a substantially rectangular shape that is received within the recess formed by sidewalls 124. When printed circuit board 66 is mounted in this recess, microphone housing 40 may protrude into opening 120 and additional circuitry 50 may protrude into recesses 122. Structure 116 and tabs 72 may be formed from a single structure (e.g., a plastic structure) that serves as both a housing for each of the dome switches (70A, 70B, and 70C) and as a structural support for the switches that allows direct attachment of button member 30 to the switches.

Figure 16:
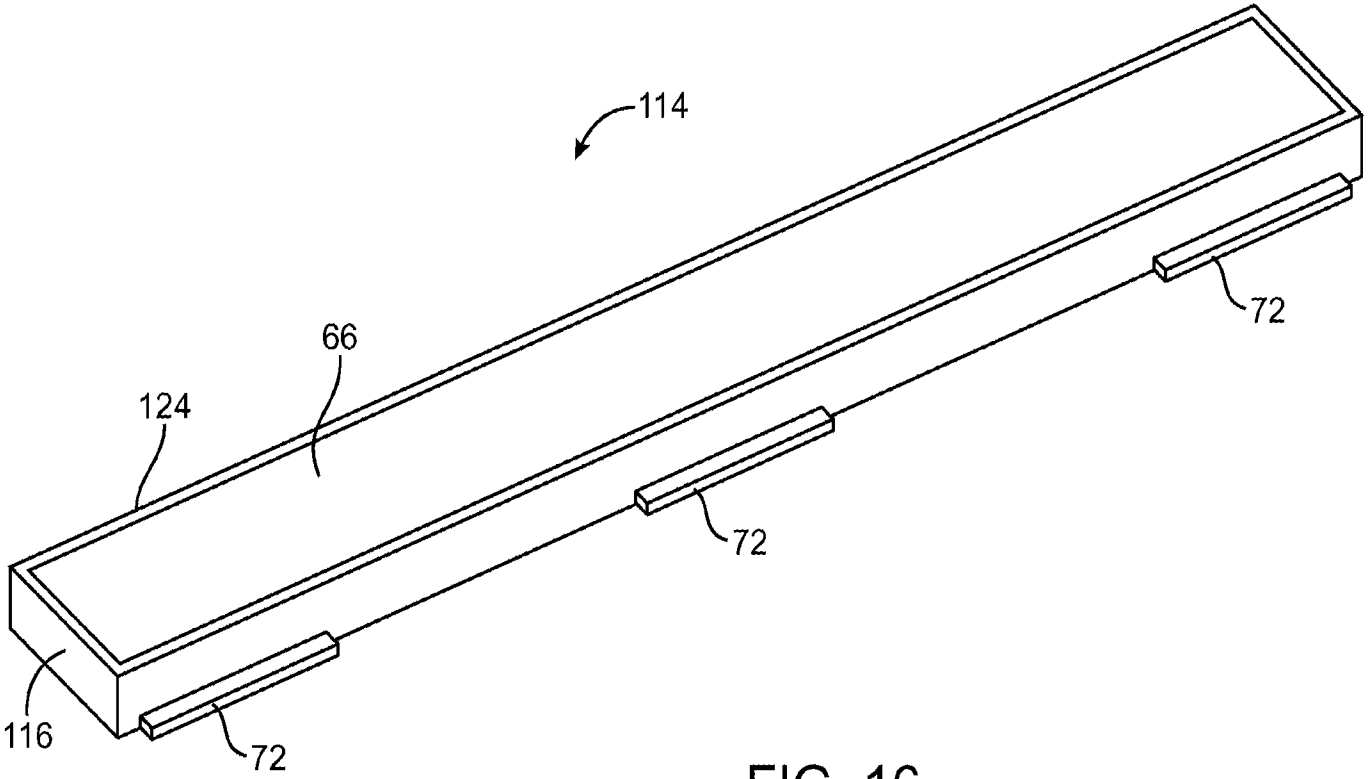

FIG. 16 is a perspective view of button controller structure 114 after printed circuit 66 of FIG. 15 has been mounted in the recess in structure 116 that is formed by sidewalls 124.

Figure 17:
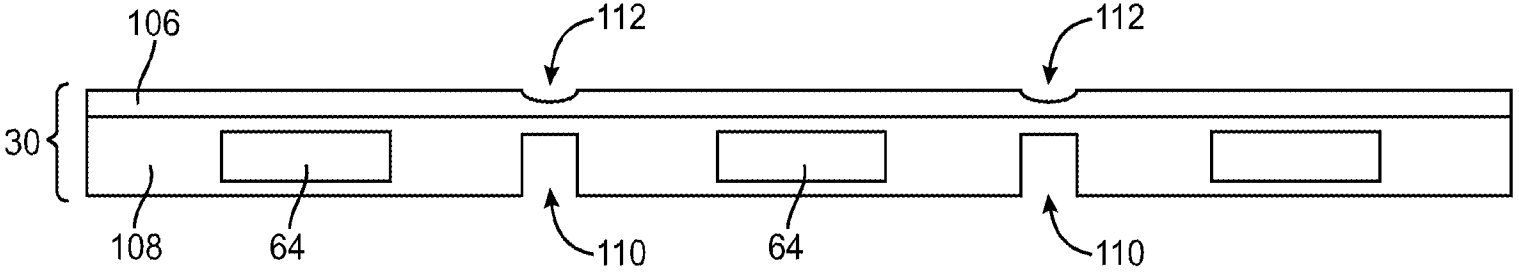

FIG. 17 is a side view of button member 30 of FIG. 12 before assembly with dome switch structure 114.

Figure 18:
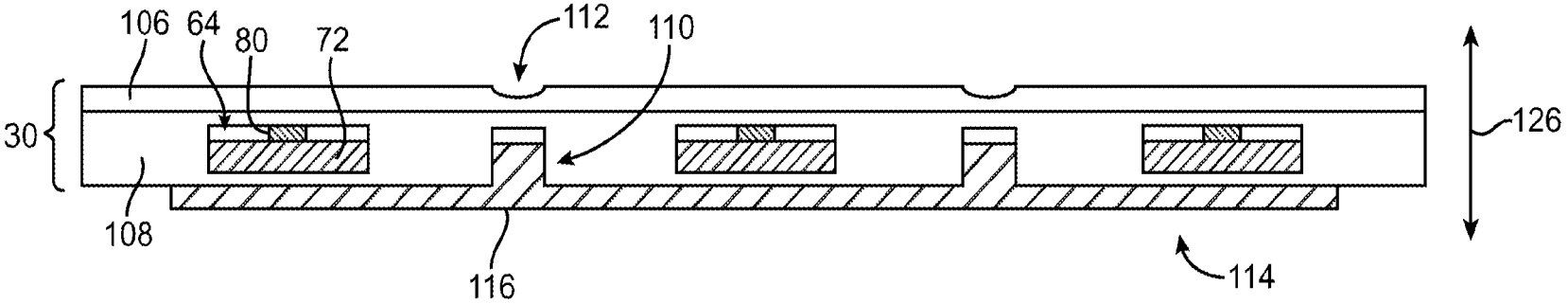

FIG. 18 is a side view of button member 30 of FIG. 12 and structure 114 of FIG. 13 after these two parts have been assembled to each other. In the assembled state of FIG. 18, tabs 72 of dome switch housing structure 116 protrude into holes 64 in frame 108 of button member 30. Holes 64 capture tabs 72. Because holes 64 have inner dimensions that are slightly larger than the outer dimensions of tables 72 (at least in vertical dimension 126), button member 30 and button cover structure 106 may travel relative to structures 116. Structures 116 may be formed as an integral portion of lower housing 32 of button controller 22 (FIG. 2) or may be attached to housing 32 (e.g., using adhesive, snaps, or other fasteners). The travel allowed by the relative sizes of holes 64 and tabs 72 allows the controller buttons to be pressed by a user to actuate the dome switches.

Figure 19:
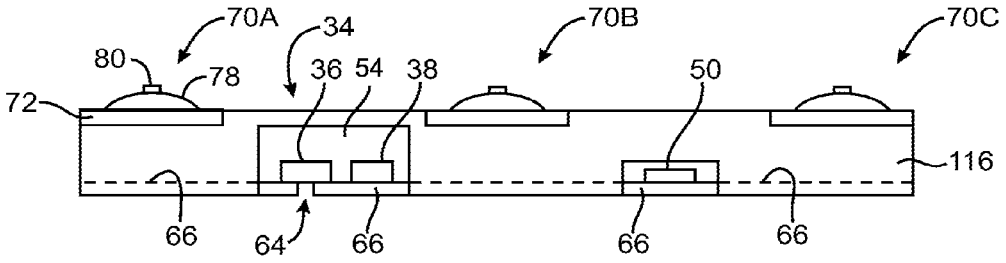

As shown in the cross-sectional side view of FIG. 19, the housing for microphone 34 may be formed as an integral part of dome switch structure 116. Transducer 36 may be mounted above hole 64 in substrate 66. Circuitry 38 and circuitry 50 may also be mounted to substrate 66. Substrate 66 may be mounted to the underside of structure 116 (e.g., in a recess of the type shown in FIG. 15). Cavity 54 may be formed from a recess in structure 116. When substrate 66 is mounted to structure 116 as shown in FIG. 19, microphone transducer 36 and circuitry 38 may be sealed within microphone cavity 54 (i.e., a cavity of the type formed by housing 40 of FIG. 3). Other recesses in structure 116 may receive protruding circuitry 50. Substrate 66 of FIG. 19 may be plastic, metal, a printed circuit board such as a rigid or flexible printed circuit board, etc. and may be attached to structure 116 using epoxy or other suitable adhesives (as an example).

Figure 20:
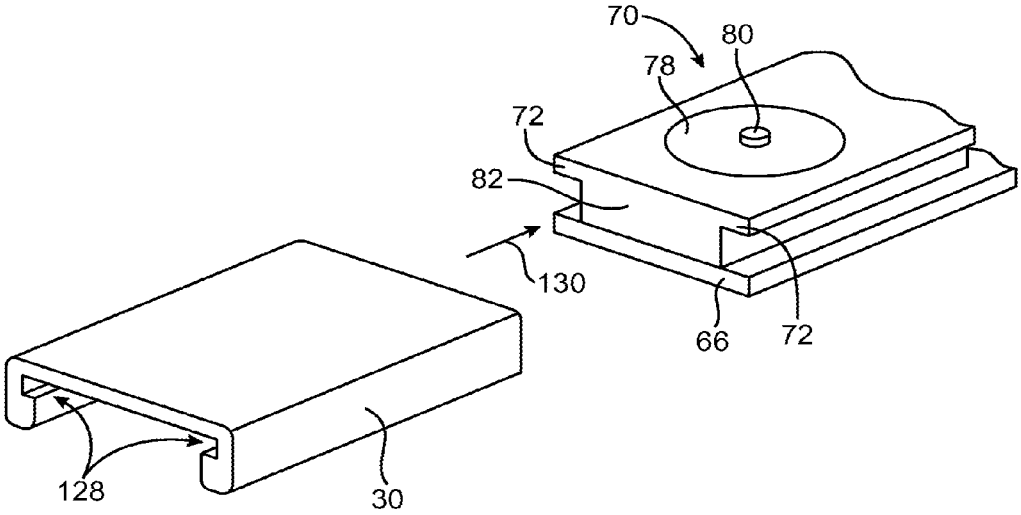

If desired, button member 30 may be assembled by sliding button member 30 into place over dome switch tabs 72. This type of assembly approach is shown in FIG. 20. As shown in FIG. 20, button member 30 may be provided with grooves such as grooves 128. Grooves 128 may be configured to mate with tabs 72 of dome switch housing 82. Button member 30 may be mounted to dome switches 70 by sliding button member 30 onto dome switches 70 in direction 130, taking care to align grooves 128 with tabs 72. Snaps or other engagement features may be used to hold button member 30 in place following assembly.

Figure 21:
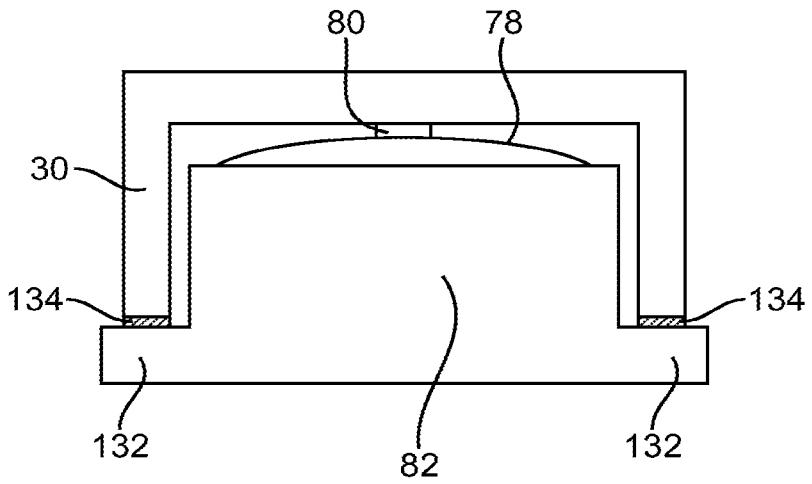

Button member 30 can be configured to flex relative to the dome switches without exhibiting travel of the type permitted by using holes 64 that are larger than tabs 72. FIG. 21 is a cross-sectional end view of a button controller structure showing how button member 30 may be attached to dome switch housing 82 (i.e., an integral support structure for multiple dome switches) at protruding dome switch ledges 132 using adhesive 134. With this type of configuration, button member 30 is rigidly attached to the dome switches, so button actuation events involve flexing of button member 30. Button member 30 may, for example, be formed from a thin metal or plastic (e.g., a thermoplastic) that is sufficiently flexible to be resiliently deformed. When an exposed button surface is pressed downwards by a user, button member 30 will flex sufficiently to actuate dome switch member 78. When the user releases the button surface, button member 30 returns to its nominal shape and releases the switch. Because button member 30 flexes, switches can be actuated without allowing the entire button member to travel relative to dome switches 70.

Figure 22:
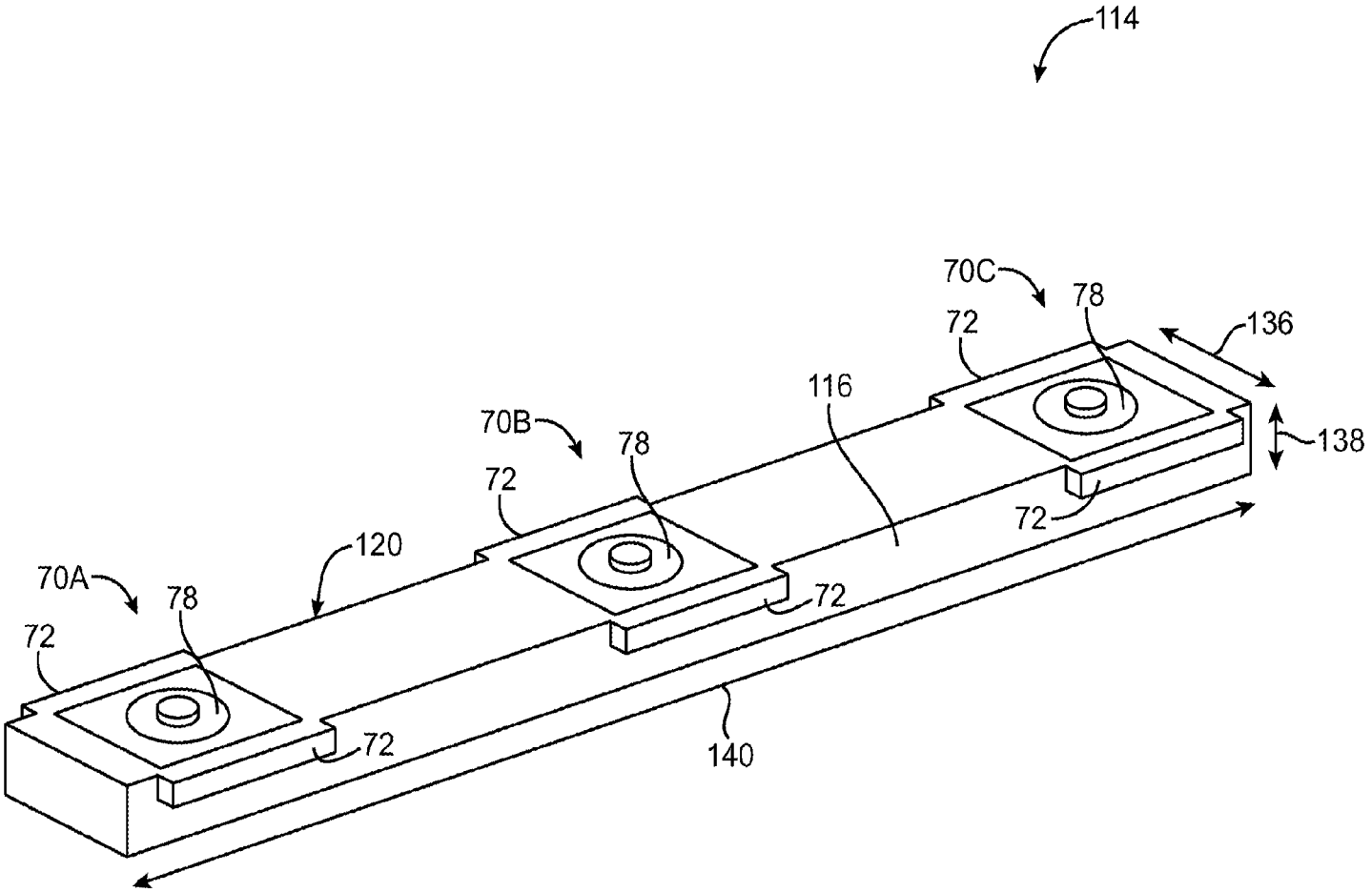

Another view of the interior portion of button controller assembly 22 illustrated in FIG. 13 is shown in FIG. 22. As shown in the example of FIG. 22, tabs 72 associated with each dome switch may lie in a common plane with the upper surface of support structure 116 (e.g., tabs 72 may lie flush with the top of structure 116). FIG. 22 also illustrates that support structure 116 (e.g., button controller structures 114) may have dimensions such as thickness 138, width 136, and length 140. In general, support structure 116 may have any suitable dimensions. With one suitable arrangement, structure 116 may have a thickness such as thickness 138 that is between 0.5 and 6.0 mm, a width such as width 136 that is between 1.0 and 10.0 mm, and a length such as length 140 that is between 20.0 and 40.0 mm. As one example, structure 116 may have a thickness of approximately 1.0 mm (e.g., a thickness between 0.9 and 1.1 mm), a width of approximately 3.0 mm (e.g., a width between 2.9 and 3.1 mm), and a length of approximately 21.0 mm (e.g., a length between 20.9 and 21.1 mm). With another suitable arrangement, structure 116 may have a height such as height 138 of 6.0 mm or less, a width such as width 136 of 10.0 mm or less, and a length such as length 140 of 40.0 mm or less. The height (i.e., the thickness) of structure 116 may include the height (i.e., the thickness) of the dome switches (e.g., dome switches 70A, 70B, and 70C) above the upper surface of structure 116 (e.g., thickness 138 may extend from the bottom surface of structure 116 to the top of the dome switches).

The foregoing is merely illustrative of the principles of this invention and various modifications can be made by those skilled in the art without departing from the scope and spirit of the invention.

What is claimed is:

1. A button controller assembly, comprising:

a button member comprising a button structure and a frame structure formed as a unitary structure, the button structure comprising grooves formed in a top surface of the button structure to define buttons with a groove interposed between adjoining buttons such that each button is configured to be flexed independently of the other buttons; and a button controller housing attached to the button member, the button controller housing enclosing a switch below each button on the button member.

2. The button controller assembly as in claim 1, wherein the frame structure comprises two sidewalls extending the length of the button structure, the sidewalls including notches formed therein, wherein respective notches are interposed between respective adjoining buttons.

3. The button controller assembly as in claim 2, wherein each respective switch is disposed in a respective switch housing.

4. The button controller assembly as in claim 3, wherein a respective switch housing includes a first engagement structure and the button member includes second engagement structures, wherein the button member is attached to the respective switch housing when the first engagement structure is coupled with a respective second engagement structure.

5. The button controller assembly as in claim 4, wherein the first engagement structure comprises tabs extending laterally outward from the respective switch housing and the respective second engagement structure comprises openings configured to mate with the tabs.

6. The button controller assembly as in claim 5, wherein the openings are formed in the sidewalls adjacent to at least one notch.

7. The button controller assembly as in claim 3, wherein the first engagement structure comprises tabs and the second engagement structure comprises grooves configured to mate with the tabs.

8. The button controller assembly as in claim 1, wherein each switch comprises a dome switch.

9. The button controller assembly as in claim 1, wherein the button controller assembly is included in a headset.

10. A button controller assembly, comprising:

a microphone housing attached to a substrate; and a support structure attached to the substrate, wherein the support structure houses a first switch and a second switch proximate to a first side of the support structure and the microphone housing protrudes into a first opening in a second side of the support structure between the first and second switches.

11. The button controller assembly as in claim 10, further comprising a button member positioned over the first and second switches and attached to the support structure, wherein the button member is configured to activate a respective switch in the support structure when the button member is pressed.

12. The button controller assembly as in claim 11, further comprising a groove formed in a top surface of the button member between the first and second switches.

13. The button controller assembly as in claim 12, further comprising a notch formed in a sidewall of the button member between the first and second switches.

14. The button controller assembly as in claim 13, wherein the support structure includes a first engagement structure and the button member includes a second engagement structure, wherein the button member is attached to the support structure when the first engagement structure is coupled with the second engagement structure.

15. The button controller assembly as in claim 14, wherein the first engagement structure comprises a tab and the second engagement structure comprises an opening configured to mate with the tab.

16. The button controller assembly as in claim 15, wherein the opening is formed in the sidewall of the button member.

17. The button controller assembly as in claim 14, wherein the first engagement structure comprises a tab and the second engagement structure comprises a groove configured to mate with the tab.

18. The button controller assembly as in claim 10, wherein the microphone housing comprises:

a housing attached to the substrate;

a transducer within the housing and attached to the substrate; and an opening formed through the substrate to allow the transducer to receive sound.

19. The button controller assembly as in claim 18, wherein the microphone housing further comprises:

circuitry attached to the substrate; and an electrical connector connecting the transducer to the circuitry.

20. The button controller assembly as in claim 10, wherein the button controller assembly is included in a headset.

21. A button controller assembly, comprising:

a button member comprising, in a unitary structure:

a top surface defining a plurality of actuation portions; and a first engagement structure; and a button controller housing attached to the button structure via the first engagement structure, the button controller housing enclosing a respective switch below each respective actuation portion of the button member;

wherein the button member is configured such that when a respective actuation portion is pressed, only the switch below the respective actuation portion is activated.

22. The button controller assembly as in claim 21, wherein each actuation portion is configured to be flexed independently of the other actuation portions.

23. The button controller assembly as in claim 22, wherein the top surface includes a plurality of distinct features, and each respective actuation portion corresponds to a respective one of the distinct features.

24. The button controller assembly as in claim 23, wherein the plurality of distinct features includes a first distinct feature and a second distinct feature, and wherein the first distinct feature is separated from the second distinct feature by a first concavity in the top surface.

25. The button controller assembly as in claim 24, wherein the plurality of distinct features includes a third distinct feature, and wherein the second distinct feature is separated from the third distinct feature by a second concavity in the top surface.

* * * * *